United States Patent [19]

Taffurelli

[11] 4,194,272

[45] Mar. 25, 1980

[54] DEVICE FOR SEAMLESS ATTACHMENT OF BUTTONS

[75] Inventor: Felice Taffurelli, Milan, Italy

[73] Assignee: Sauro Albertini, Viganello, Switzerland

[21] Appl. No.: 957,990

[22] Filed: Nov. 6, 1978

[30] Foreign Application Priority Data

Nov. 14, 1977 [IT] Italy ..... 2933 A/77

[51] Int. Cl.[2] ..... A44B 1/28; A44B 1/18

[52] U.S. Cl. ..... 24/90 R; 24/90 E; 85/13; 85/21

[58] Field of Search ..... 24/90 R, 90 E, 93

[56] References Cited

U.S. PATENT DOCUMENTS

| | | | |
|---|---|---|---|
| 1,801,850 | 4/1931 | Erwin | 24/90 R |
| 2,228,043 | 1/1941 | Baggerud | 24/90 R |

*Primary Examiner*—Bernard A. Gelak

[57] ABSTRACT

Device for seamless attachment of buttons for use on buttons provided with conventional holes, comprising a base element to be placed under the button between the button itself and cloth, wherein such a base element comprises through holes intended to at least partially coincide with the button holes, and wherein said through holes are internally provided with retaining means, preferably in the form of annular flats or projecting ridges, as well as fastening means, preferably in the form of rivet-like elements to be inserted on one side in the button holes to downwardly project into said base element, and on the other side to be inserted in the cloth for similarly engaging said base element, the engagement from one to the other side being carried out by means of the projections provided on the shank of said rivet-like elements hooking on said annular flats or projecting ridges provided internally of the base element holes.

7 Claims, 6 Drawing Figures

DEVICE FOR SEAMLESS ATTACHMENT OF BUTTONS

This invention relates to a device for seamless attachment of buttons, and more particularly is concerned with a device using for such a purpose the conventional holes existing in a button, wherein conventional holes are meant as those provided both on the button plane and on the stalk or the button-hole provided behind the button.

Several embodiments for seamless attachment of buttons are already known. However, all of the prior art embodiments have the common feature that the button being used is a special button made to suit that particular purpose and provided with various elements of attachment integral with the button for engagement of the latter with the fabric or cloth through a possible counter-part. This results in the disadvantage that a plurality of operations should be provided in button manufacture, thus involving an increase in cost thereof. Additionally, the attachment parts steadily provided on the button are mostly scarcely resistant, so that the button applied to a garment may be easily lost.

It is the object of the present invention to provide a device overcoming the above mentioned disadvantages, and particularly allowing a seamless attachment of conventional buttons by using to this end the holes already provided in the button.

According to the invention, this is accomplished by a device for the aforesaid objects, characterized by comprising a base element to the placed under the button, said base element including through holes designed to coincide with the button holes, and wherein internally of said through holes retaining means are provided for a button attachment counter-element, fastening means to be inserted in the button holes and intended to engage through flats or projecting ridges thereof said retaining means of the through holes, and at least one fastening head to be inserted through the fabric or cloth, intended to pass through the latter by means of a tip or point thereof for engagement in a retaining means provided in a through hole of said base element.

According to a preferred embodiment of the invention, said base element comprises a plastic material body carrying on its upper periphery tab elements to bear against the button, and having in its body three through holes, wherein the retaining means internally of said through holes comprise engagement rings projecting to the hole center.

According to another embodiment of the invention, said fastening means to be inserted from the top in the button holes comprise rivet-like elements of plastic material having a shank with flats or projecting ridges for engagement within said rings of the through holes in said base element.

According to a further embodiment of the invention, said upper rivet-like elements comprise a pair of U-joined rivets.

The invention also provides that said U-shaped element has in its upper cross-leg or rod an element arranged in a transverse direction thereto and provided with downwardly bent stems at the two ends.

An embodiment of the invention provides that, where a four-hole button is concerned, the upper rivet-like elements and lower base are arranged so that attachment occurs on two holes of the button according to the direction of a diagonal of that square at the vertices of which the four holes of the button would lie.

These and further objects, features, details and advantages of the device according to the present invention will become more apparent to those skilled in the art from the following brief detailed description of an unrestrictive embodiment in connection with the accompanying drawings, in which.

Referring now to the accompanying drawings, first it will be appreciated that the details have been much enlarged and exagerated for illustration purposes.

Figure 1:
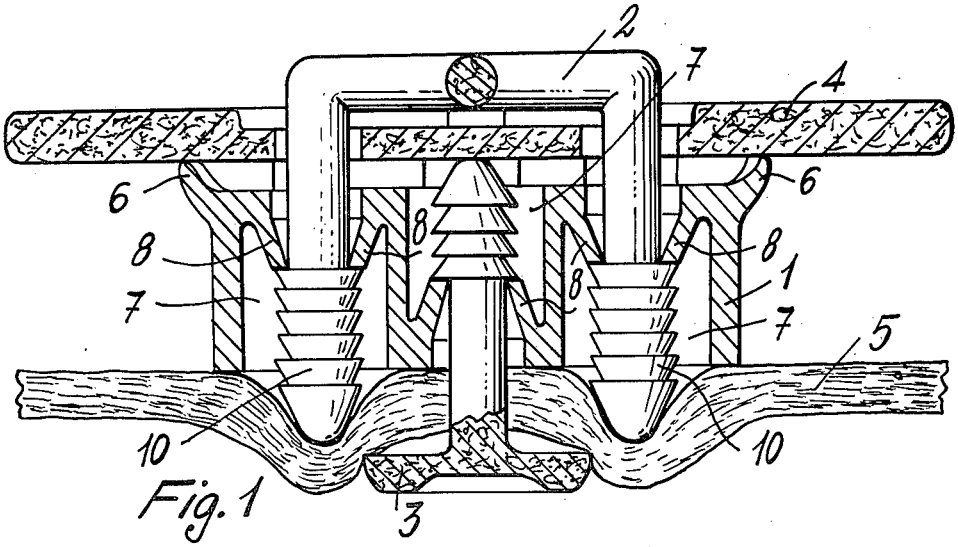
FIG. 1 is a partly cutaway view showing a device according to the invention as applied for attachment of a button on fabric or cloth material.
Figure 2:
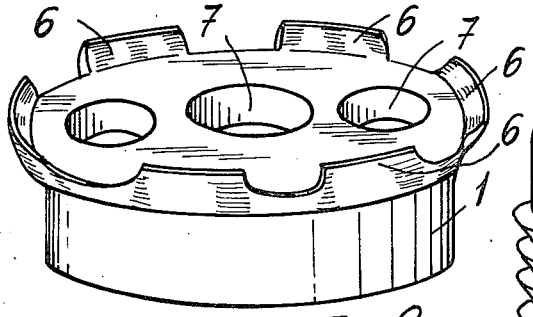
FIGS. 2, 3, 4 and 5 are perspective views showing the elements comprising the device according to the invention.

A device according to the invention comprises a base element 1 intended to be placed under a button 4 and over a fabric or cloth material 5, top fastening means 2 for passing through the holes in said button 4 and engaging in said base element 1, and a lower fastening head 3 intended to pass through said fabric or cloth material 5 by its tip or point and engage in said base element 1 as well. As a whole, this is very clearly depicted in FIG. 1. Particularly, it should be noted that base element 1 comprises a plastic material body, having at its top portion tab-like elements 6 for bearing and fitting against the underside of button 4. In this exemplary embodiment shown, said body 1 comprises three through holes 7, within which rings 8 are provided and branch from the hole sides to converge to the center. In the two side holes said rings 8 are facing in downward direction, and in the central hole are facing in upward direction.

Figure 3:
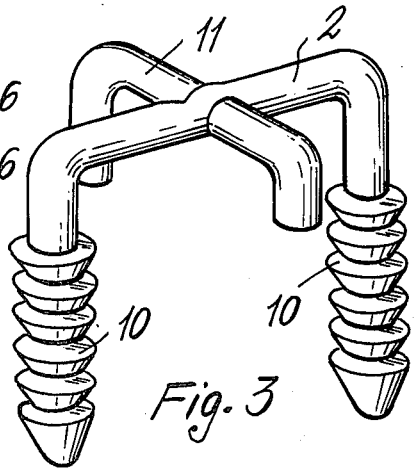
Figure 4:
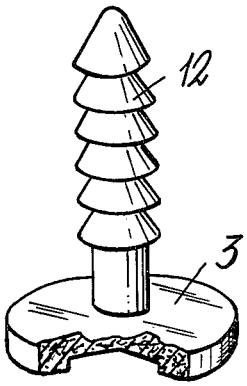
Figure 5:
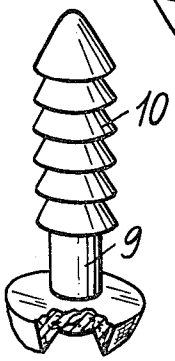
Figure 6:
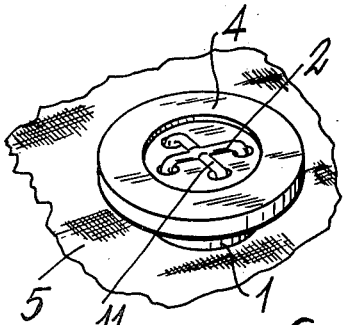
FIG. 6 is a top partly perspective view showing a button as attached according to the invention.

The fastening means designated at 2 may comprise either individual rivet-like elements 9 (see FIG. 5), the flats or projecting ridges 10 on the stems thereof are for engagement with said rings 8 in holes 7, or such rivet-like elements may be connected by a U-bolt member, as shown in FIG. 3. Such a U-bolt member may also have a transverse element 11 with downward facing ends, particularly when desiring to attach four-hole buttons, as shown in FIG. 6.

For example, when desiring to attach a four-hole button, the procedure would be as follows:

Element 1 is placed under button 4 so that its two side holes 7 coincide with two of said button holes, selecting these two holes at the two ends of a diagonal in the square, at the vertices of which the four holes of the button lie. Then, the assembly shown in FIG. 3 is inserted from the top, so that elements 10 engage in the underlying rings 8, while element 11 will cover with its two ends the two free holes of the button. Successively, from the bottom and through said fabric or cloth material 5, the point or tip 12 of a head 3 is inserted, while its flats or projecting ridges at 12 remain engaged within rings 8 of central hole 7 in element 1, and head 3 is brought to bear against the fabric or cloth material. Thus, the button is attached to the fabric or cloth material, as clearly shown in FIGS. 1 and 6.

In case of two-hole buttons, the assembly shown in FIG. 3 will be missing of transverse element 11. Moreover, as above mentioned, also individual rivet-like elements 9 can be used, as shown in FIG. 5.

By suitable modifications, also buttons can be attached as having holes provided in the shank portion, or buttons provided with hook elements. Thus, it would only be required to form suitable seats in said element for fastening said shank portion or hook element.

Of course, the invention is not restricted to the details herein shown and/or described, but comprises all of those modifications and equivalent forms that can be conceived on the ground of the present invention.

What I claim is:

1. A device for seamless attachment of buttons intended to be used on buttons having conventional holes, the device comprising a base element to be placed under the button, said base element including through holes designed to coincide with the button holes, and wherein retaining means are provided within said through holes for a fastening counter-element of the button, fastening means to be inserted in the button holes and designed for engagement with flats or projecting ridges thereof in said retaining means provided in said through holes, and at least one fastening head for insertion through the fabric or cloth material, intended to pass through retaining means provided in a through hole of said base element.

2. A device as set forth in claim 1, wherein said base element comprises a plastic material body carrying on its upper periphery tab elements for bearing against the button and having in its body three through holes, the two side holes of which are designed for engagement with the fastening means to be inserted from the top, and the center hole of which is designed for engagement with the point or tip of said fastening head to be inserted from the bottom, respectively, and wherein said retaining means within said through holes comprise engaging rings downwardly projecting in said two side holes and upwardly projecting in said central hole.

3. A device as set forth in claim 1, wherein said fastening means to be inserted from the top through the button holes comprise rivet-like elements of plastic material having a stem provided with flats or projecting ridges for engagement in said engaging rings for the through holes of said base element.

4. A device as set forth in claim 3, wherein said rivet-like elements comprise a pair of rivets connected by a U-bolt member.

5. A device as set forth in claim 4, wherein at its upper rod or leg portion said U-bolt member has an element transverse thereto provided with downwardly bent stems.

6. A device as set forth in claim 1, wherein the stem of said fastening head has flats or projecting ridges.

7. A device as set forth in any of the preceding claims, wherein where four-hole buttons are concerned, the upper rivet-like elements and the lower base element are so arranged that fastening occurs on two holes of the button located at the two ends of a diagonal in a square, at the vertices of which the four holes of the button are arranged.

* * * * *